United States Patent [19]

Laviano

[11] Patent Number: 4,580,437

[45] Date of Patent: Apr. 8, 1986

[54] PRESS CONSTRUCTION

[76] Inventor: Samuel Laviano, 85 S. Poplar St., Gibbstown, N.J. 08027

[21] Appl. No.: 576,451

[22] Filed: Feb. 2, 1984

[51] Int. Cl.[4] ..... B21J 9/18

[52] U.S. Cl. ..... 72/450; 72/389

[58] Field of Search ..... 72/389, 444, 450, 482, 72/, 455, 465, 414, 415; 83/643, 698

[56] References Cited

U.S. PATENT DOCUMENTS

| | | | |
|---|---|---|---|
| 1,494,594 | 7/1923 | Diamond | 83/643 |
| 2,486,428 | 11/1949 | Minor | 72/415 |
| 2,917,956 | 12/1959 | Merion | 72/415 |
| 3,118,407 | 1/1964 | Robb | 72/444 |
| 3,233,492 | 2/1966 | Rupp | 83/698 |
| 3,780,610 | 12/1973 | Zadow | 83/643 |

*Primary Examiner*—Francis S. Husar
*Assistant Examiner*—Robert Showalter
*Attorney, Agent, or Firm*—Robert K. Youtie

[57] ABSTRACT

A press wherein a pair of press members are connected together by a generally parallel linkage and a hydraulic or other fluid pressure mechanism is connected between the press members to forcibly move the latter together for forming a workpiece therebetween.

6 Claims, 5 Drawing Figures

PRESS CONSTRUCTION

BACKGROUND OF THE INVENTION

This invention relates generally to metal working apparatus, and is especially concerned with a press employing die carrying bodies constrained to movement toward and away from each other by pivoted links and forcibly movable together by a fluid pressure operator interconnected between the bodies.

SUMMARY OF THE INVENTION

It is an important object of the present invention to provide a press construction of the type described wherein a pair of die carrying bodies are constrained to move toward and away from each other by spaced links pivotally connected to the bodies, and the fluid pressure operating means includes a piston-and-cylinder assembly pivotally connected between the bodies.

It is still a further object of the present invention to provide a press construction of the type described in the preceding paragraph wherein the fluid pressure means is located outboard of the connecting links, and the link remote from the fluid pressure means is disconnectible from at least one of the press bodies to afford an additional dimension of access to the space between the press bodies, as for removal of a workpiece formed about one of the press bodies.

It is still another object of the present invention to provide a press construction having the advantageous characteristics mentioned in the preceding paragraph, wherein the body connecting links are generally parallel, for parallel movement of the bodies, and wherein a retaining latch or holder is provided between a link proximate to the fluid pressure operating means and the adjacent body, to retain the latter away from the other body upon disconnection of a remote link.

It is still another object of the present invention to provide a press construction which is extremely simple to manufacture, requiring only a minimum of parts and machining; wherein the possibility of cocking or uneven movement of the press bodies toward each other is minimized or eliminated; and further wherein work that is substantially or completely closed may be quickly and easily removed from the press without opening or bending back of the work to clear the parts of the press.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENT

Figure 1:
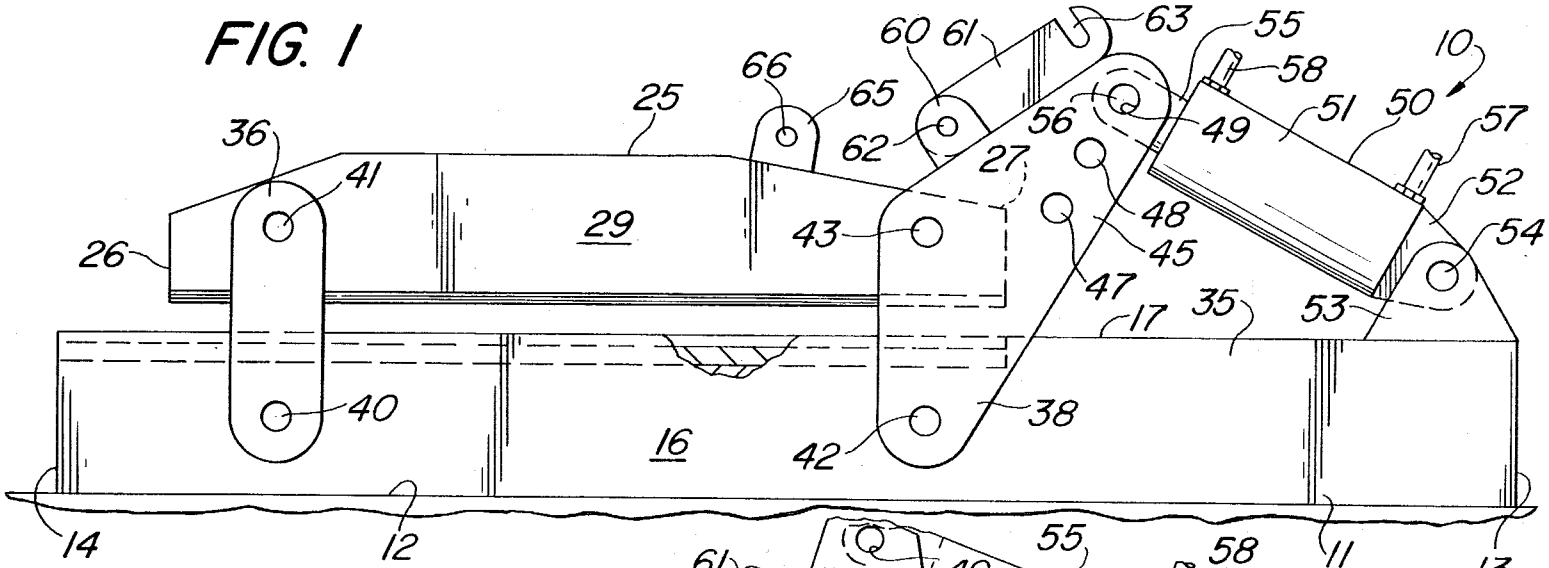
FIG. 1 is a side elevational view showing the press of the present construction in an open condition.
Figure 3:
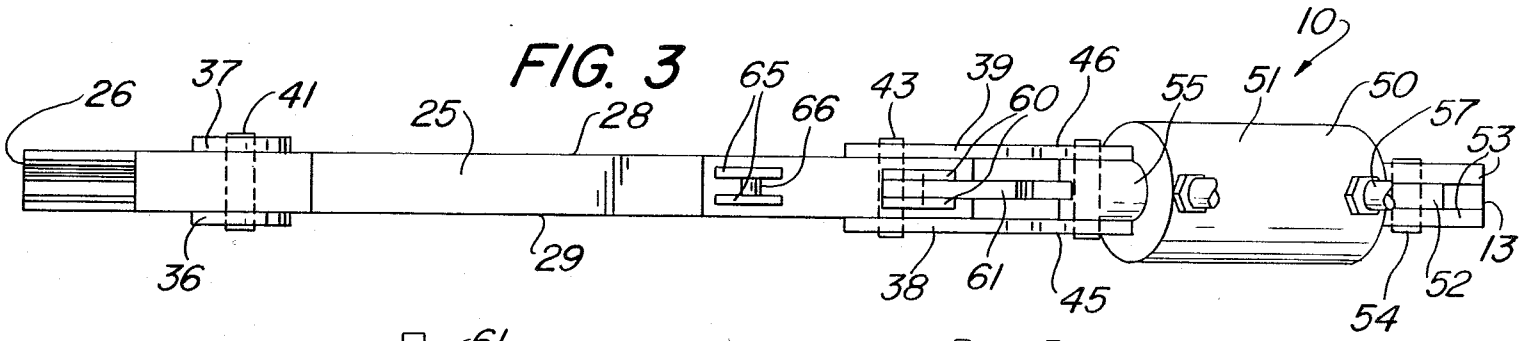
FIG. 3 is a top plan view of the press in FIG. 1.
Figure 5:
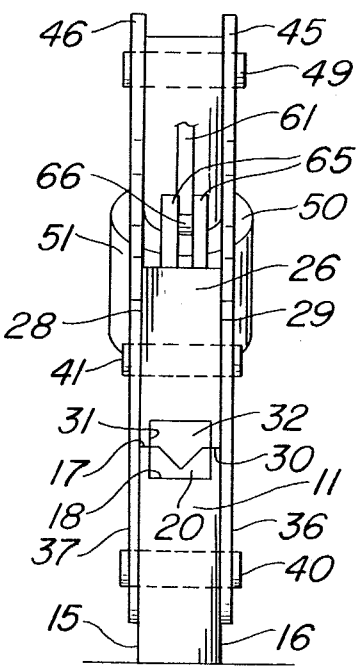
FIG. 5 is an end elevational view, as from the left in FIG. 2.
Figure 4:
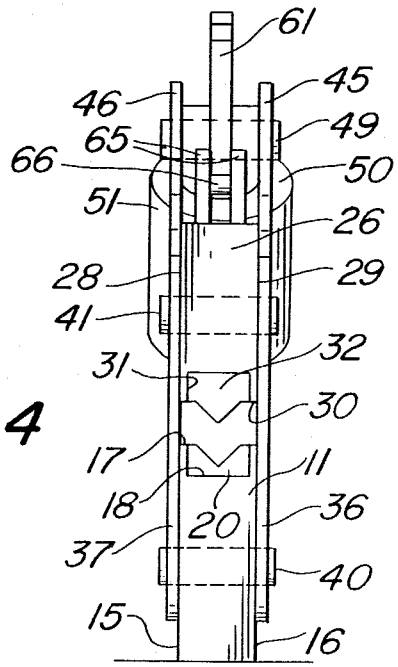
FIG. 4 is an end elevational view of the press, as from the left in FIG. 1.

Referring now more particularly to the drawings, and specifically to FIG. 1 thereof, a press is there generally designated 10, and includes a lower press body or bed 11 adapted to rest on a suitable supporting surface 12, such as a floor, or elevated platform. The lower press body or bed 11 may be generally rectangular in outline, and is illustrated as being horizontally elongate in the side views of FIGS. 1 and 2, having opposite ends 13 and 14. In FIGS. 3–5, it may be seen that the lower press body or block 11 is of a lesser, horizontally transverse dimension, as between opposite sides 15 and 16. However, these proportions are not essential, and the length between ends 13 and 14 may be reduced, while the width between sides 15 and 16 may be increased.

The upper surface 17 of the bed 11 may be generally horizontal, and substantially flat, and may be provided with a suitable die receiver 18, which may be an elongate groove, as in the illustrated embodiment, spaced laterally between the side surfaces 15 and 16, and receiving a lower die 20. The die 20 may be of any desired configuration, such as the illustrated female die having a groove.

Superposed over the lower press body or bed is an upper press body or block 25, which may also be of elongate configuration, as between opposite ends 26 and 27, and may be of a transverse dimension or width approximately equal to that of the bed 11, as between sides 28 and 29.

The upper press body or block 25 may have its lower surface 30 generally parallel to the upper surface 17 of bed 11, and may be provided therein with a die receiver 31, such as a groove, for receiving a die element 32 complementary to the lower die element 20. Any suitable means may be provided to removably retain the die elements 20 and 32 in their respective receivers 18 and 31.

Figure 2:
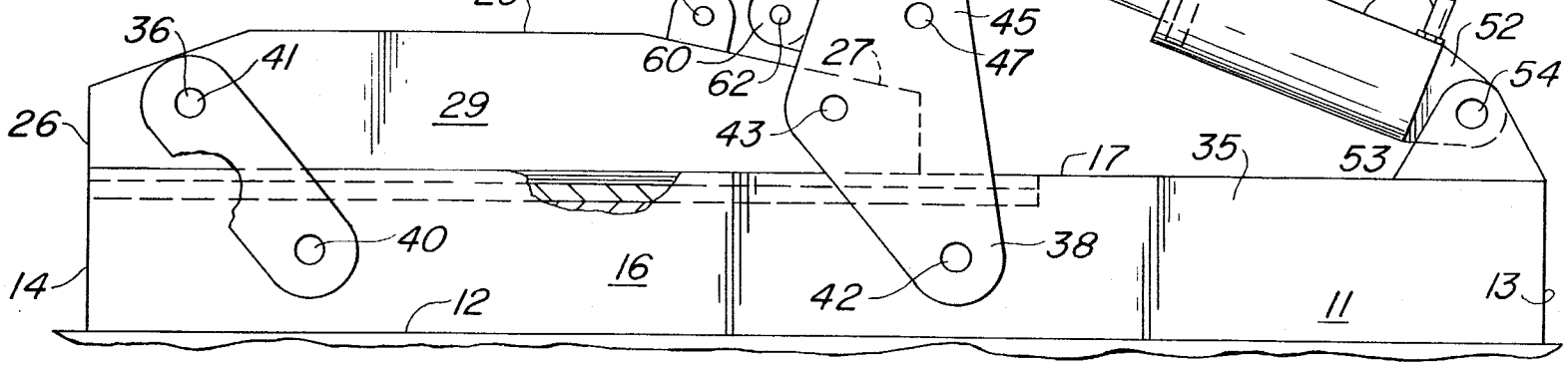
FIG. 2 is a side elevational view similar to FIG. 1, showing the press closed, with parts broken away for clarity.

As best seen in FIGS. 1 and 2, the lower press body or bed 11 is longer than the upper press body or block 25, the bed extending considerably beyond the block, as in the region 35 toward the right in FIGS. 1 and 2.

Kinematically connecting the press bodies 11 and 25 for relative movement toward and away from each other are two sets of laterally opposed links, one set being 36 and 37, and the other set being 38 and 39. The leftward or outer pair of links 36 and 37, as seen in FIGS. 1–3 are generally parallel to each other, both being pivotedly connected at their lower ends by a lower pin 40 in the bed 11, and both being connected at their upper ends by an upper pin 41 in the upper press member or block 25.

The other laterally opposed set of links 38 and 39, being spaced rightward from the links 36 and 37, and between the ends 13 and 14 of bed 11, each have their lower ends pivoted, as by a pin 42 to the press bed 11, and are pivoted in an upper region by a pin 43 to the press body or block 25. Further, the bed 11 and block 25 are parallel to each other, while the link set 36 and 37 between pins 40 and 41 are parallel to the link set 38 and 39 between the pins 42 and 43. Thus, the press block 25 and bed 11 are connected by a parallel linkage 36, 37, 38 and 39, for movement of the block in parallelism with and toward and away from the bed. Of course, this displaces the die members 20 and 32 into and out of complementary forming relation with respect to each other.

The links 38 and 39 are provided with upward and outward extensions 45 and 46 beyond the upper pin 43. The extensions 45 and 46 may be generally parallel to each other and provided with a series of pairs of pin receivers or holes 47, 48 and 49 arranged in a row and at differently spaced locations from pin 42.

Outboard of the links 38 and 39, remote from the links 36 and 37, and over the bed extension 35, is a fluid pressure operator 50. The operator 50 may include a piston-and-cylinder assembly 51, having a lug 52 extending from one end of the assembly 51 into an upstanding, journal block or gudgeon 53, a pintle 54 extending through both the gudgeon and lug. The lug 52 may be rigid with the cylinder of the assembly 51.

The fluid pressure assembly 51 may extend upwardly and inwardly from the journal block 53 over the bed extension 35; and, projecting from the other end of the assembly 51 may be an extensile and retractile piston rod 55. The piston rod 55 enters between the link extensions 45 and 46, and a pin 56 may extend rotatably through the link extensions and intermediate piston rod, being received in a selected set of journal holes 47, 48, 49. Suitable fluid conducting means or conduits 57 and 58 may connect to opposite ends of the assembly 51, interiorly of the cylinder thereof on opposite sides of the piston therein. Thus, by suitable valved connections (not shown) the piston rod 55 may be extended, as in FIG. 2, to move the press bodies 25 and 11 toward each other, and retracted to move the press bodies away from each other.

In the retracted position of press bodies away from each other, as in FIGS. 1 and 4, a workpiece may be inserted in the space between the press bodies, and the assembly 51 actuated to move the press bodies toward each other and deform the workpiece. Of course, a wide variety of shapes, sizes and configurations of workpieces may be produced, in accordance with the selected dies and operating procedures. It is not uncommon to form a series of bends in a single workpiece at spaced locations therealong, as by shifting the workpiece between bent formations, to result in a closed or substantially closed workpiece extending entirely or substantially entirely about the press block 25. In such a situation, the workpiece may be removed in its fully formed shape by disconnecting the links 36 and 37 from one of the press bodies 11, 25. For example, removing the upper pin 41 and letting the links 36 and 37 fall away from the upper press body. The workpiece may then be moved leftward over the body 25.

In order to prevent dropping of the upper press body or block 25 when the links 36 and 37 are disconnected from the upper block, a detachable link or latch may be provided between the link extensions 45 and 46 and the upper side of the block 25. For example, a pair of upstanding lugs 60 may be welded or otherwise suitably fixed to and upstanding from respective link extensions 45 and 46. An elongate latch member or detachable link 61 may have one end pivotally retained between the lugs 60, as by a pin 62. Adjacent to the other end of the link or latch member 61 may be provided an open catch or notch 63. Suitably fixed to the upper side of the block 25, spaced between the block ends 26 and 27, may be a a pair of lugs 65, being laterally spaced apart and having extending therebetween a pin 66. The pin 66 is spaced from the pin 62 such that the latch 61 will receive in its notch 63 the pin 66 when the press bodies are parallel. Thus, the links 36 and 37 may be detached from the upper block 25, and the latch or retainer 61 will serve to hold the upper block 25 generally parallel to and spaced away from the bed 11, to facilitate access to the workspace between the press bodies.

From the foregoing, it is seen that the press construction of the present invention is adapted to be manufactured and assembled at a reasonable cost, is operable to effectively eliminate the possibility of cocking as in conventional presses, while uniquely affording access to the workstation and removal therefrom of complex workpieces of closed configuration.

Although the present invention has been described in some detail by way of illustration and example for purposes of clarity of understanding, it is understood that certain changes and modifications may be made within the spirit of the invention.

What is claimed is:

1. A press comprising a bed, a press block in face-to-face relation with and having opposite ends respectively adjacent to opposite ends of said bed, said bed and block being of substantially the same width, a pair of links on opposite sides immediately outwardly of and at each pair of adjacent ends of said bed and block, pivots directly connecting each link to said block and bed for moving the same toward and away from each other in general parallelism, fluid pressure means located at one pair of adjacent ends of and connected between said block and bed for effecting forcible movement of said block and bed toward each other, and die means on the faces of said block and bed for forming therebetween a workpiece upon said movement toward each other, the pivots connecting the pair of links remote from said fluid pressure means being disconnectible from said block to open the space between said block and bed for removal of a workpiece formed to extend in closed relation about said block without obstruction by appendages to said block.

2. A press according to claim 1, in combination with a latch detachably connected between the upper side of said block and the links proximate to said fluid pressure means for retaining said block upwardly against downwardly swinging movement toward said bed when said pivots connecting the remote links are disconnected.

3. A press according to claim 2, said proximate links being pivotally connected to said fluid pressure means.

4. A press according to claim 3, said proximate links including an extension beyond said block away from said bed, said fluid pressure means being pivotably connected to said link extension, for force multiplication.

5. A press according to claim 4, said latch being connectable between said link extension and block.

6. A press according to claim 1, said links being generally parallel for parallel movement of said block and bed.

* * * * *